US011043342B2

(12) United States Patent
Rabb et al.

(10) Patent No.: US 11,043,342 B2
(45) Date of Patent: Jun. 22, 2021

(54) CHANGE-OVER SWITCH

(71) Applicant: ABB Schweiz AG, Baden (CH)

(72) Inventors: Patrik Rabb, Vaasa (FI); Rainer Kolmonen, Vaasa (FI); Mikko Välivainio, Vaasa (FI)

(73) Assignee: ABB Schweiz AG, Baden (CH)

( * ) Notice: Subject to any disclaimer, the term of this patent is extended or adjusted under 35 U.S.C. 154(b) by 6 days.

(21) Appl. No.: 16/820,111

(22) Filed: Mar. 16, 2020

(65) Prior Publication Data

US 2020/0219683 A1 Jul. 9, 2020

Related U.S. Application Data

(63) Continuation of application No. PCT/FI2018/050662, filed on Sep. 13, 2018.

(30) Foreign Application Priority Data

Sep. 15, 2017 (EP) ..... 17191315

(51) Int. Cl.
*H01H 9/34* (2006.01)
*H01H 19/50* (2006.01)
*H01H 71/08* (2006.01)

(52) U.S. Cl.
CPC ..... *H01H 19/50* (2013.01); *H01H 9/342* (2013.01); *H01H 71/08* (2013.01)

(58) Field of Classification Search
CPC ..... H01H 19/50; H01H 19/38; H01H 19/42; H01H 19/46; H01H 19/626; H01H 19/64;
(Continued)

(56) References Cited

U.S. PATENT DOCUMENTS 3,484,570 A * 12/1969 Swanson ..... H01H 5/06 200/48 R
4,590,387 A * 5/1986 Yoshida ..... H01H 50/644 200/50.33

(Continued)

FOREIGN PATENT DOCUMENTS

CH 330629 A 6/1958
CN 105374595 A 3/2016

(Continued)

OTHER PUBLICATIONS

Finnish Patent Office, International Search Report & Written Opinion issued in corresponding Application No. PCT/FI2018/050662, dated Feb. 4, 2019, 26 pp.

(Continued)

*Primary Examiner* — William A Bolton
(74) *Attorney, Agent, or Firm* — Taft Stettinius & Hollister LLP

(57) ABSTRACT

A change-over switch including a frame having a first side wall and a second side wall, a first supply terminal, a second supply terminal, a load terminal, and at least one gas flow opening for discharging gasses from the frame. The second side wall faces substantially opposite direction relative to the first side wall. The change-over switch is adapted to selectively provide a first connection between the first supply terminal and the load terminal, and a second connection between the second supply terminal and the load terminal. The first supply terminal and the second supply terminal project from the first side wall, and the load terminal projects from the second side wall. The at least one gas flow opening is formed in the second side wall.

18 Claims, 4 Drawing Sheets

(58) Field of Classification Search
CPC .... H01H 9/342; H01H 1/2041; H01H 1/2058; H01H 1/365; H01H 1/42; H01H 1/58; H01H 71/08; H01H 73/045; H01H 50/54; H01H 50/644; H01H 3/22; H01H 3/32
USPC ..... 218/100, 101; 200/175
See application file for complete search history.

(56) References Cited

U.S. PATENT DOCUMENTS

| | | | | |
|---|---|---|---|---|
| 7,009,132 | B1 | 3/2006 | Shea et al. | |
| 2007/0062912 | A1 | 3/2007 | Rival | |
| 2013/0015044 | A1* | 1/2013 | Lee | H02J 9/06 200/175 |
| 2015/0371792 | A1* | 12/2015 | Feng | H01H 9/26 200/10 |
| 2017/0103865 | A1* | 4/2017 | Ji | H01H 50/54 |

FOREIGN PATENT DOCUMENTS

| | | | |
|---|---|---|---|
| CN | 105655160 | B | 10/2017 |
| DE | 102013202811 | A1 | 8/2014 |
| GB | 193538 | A | 3/1923 |
| WO | 2014170528 | A1 | 10/2014 |

OTHER PUBLICATIONS

European Patent Office, Search Report issued in corresponding Application No. 17191315.5, dated Feb. 21, 2018, 2 pp.

* cited by examiner

CHANGE-OVER SWITCH

FIELD OF THE INVENTION

The present invention relates to a change-over switch.

A change-over switch is a switching device comprising a first supply terminal, a second supply terminal and a load terminal, and adapted to selectively provide a first connection between the first supply terminal and the load terminal, and a second connection between the second supply terminal and the load terminal. When a current circuit of a change-over switch is opened, an electric arc whose temperature is thousands of degrees may occur in the change-over switch. An electric arc includes ionized gas, which contains a large number of free electrons. Such a gas plasma is electrically conductive.

In addition to the fact that electric arc is conductive, metal which has been vaporized from contact surfaces by the electric arc may, upon solidification, impair the insulation capacity of the surfaces of the switching device. Soot produced by the electric arc may also cause insulation problems.

It is known in the art to provide a change-over switch with a gas discharge arrangement for discharging gasses produced by switching events from a frame of the change-over switch, the gas discharge arrangement comprising gas flow openings formed in a side wall of the frame. The gas discharge arrangement enables expanded gas to discharge from the frame of the change-over switch, which prevents pressure inside the frame from becoming too high.

One of the problems associated with known change-over switches is that in connection with a switching event, gas discharging from the frame through the gas flow openings may cause a short circuit. Depending on the design of the change-over switch, and the environment of the change-over switch, said short circuit may occur between a terminal of the change-over switch and an adjacent earthed part, or between terminals of the change-over switch. Risk for the short circuit may increase gradually due to electrically conductive material that is deposited in the vicinity of the gas flow openings.

BRIEF DESCRIPTION OF THE INVENTION

An object of the present invention is to provide a change-over switch so as to solve the above problem. The objects of the invention are achieved by a change-over switch which is characterized by what is stated in the independent claim 1. The preferred embodiments of the invention are disclosed in the dependent claims.

The invention is based on the idea of locating a first supply terminal and a second supply terminal on a first side wall of a frame of a change-over switch while a load terminal is located on a second side wall facing substantially opposite direction relative to the first side wall, and providing the change-over switch with a gas discharge arrangement adapted to discharge gasses produced by switching events through gas flow opening(s) formed in the second side wall.

An advantage of the change-over switch of the invention is that a risk of a short circuit is reduced in connection with opening a current circuit of the change-over switch, because the gas flow opening(s) are on the same side wall as the load terminal which is at the same electric potential as the supply terminal whose current circuit is being opened in the switching event in question. Further, long gas discharge passages cool gasses produced by switching events, and remove at least part of metal particles vaporized from contact surfaces by the switching events. Lowering temperature of the exhaust gases lowers electrical conductivity of the exhaust gases. Reducing amount of metal particles in the gas flow exiting the frame reduces amount of electrically conductive material that is deposited outside the gas flow openings, in the vicinity of the gas flow openings.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
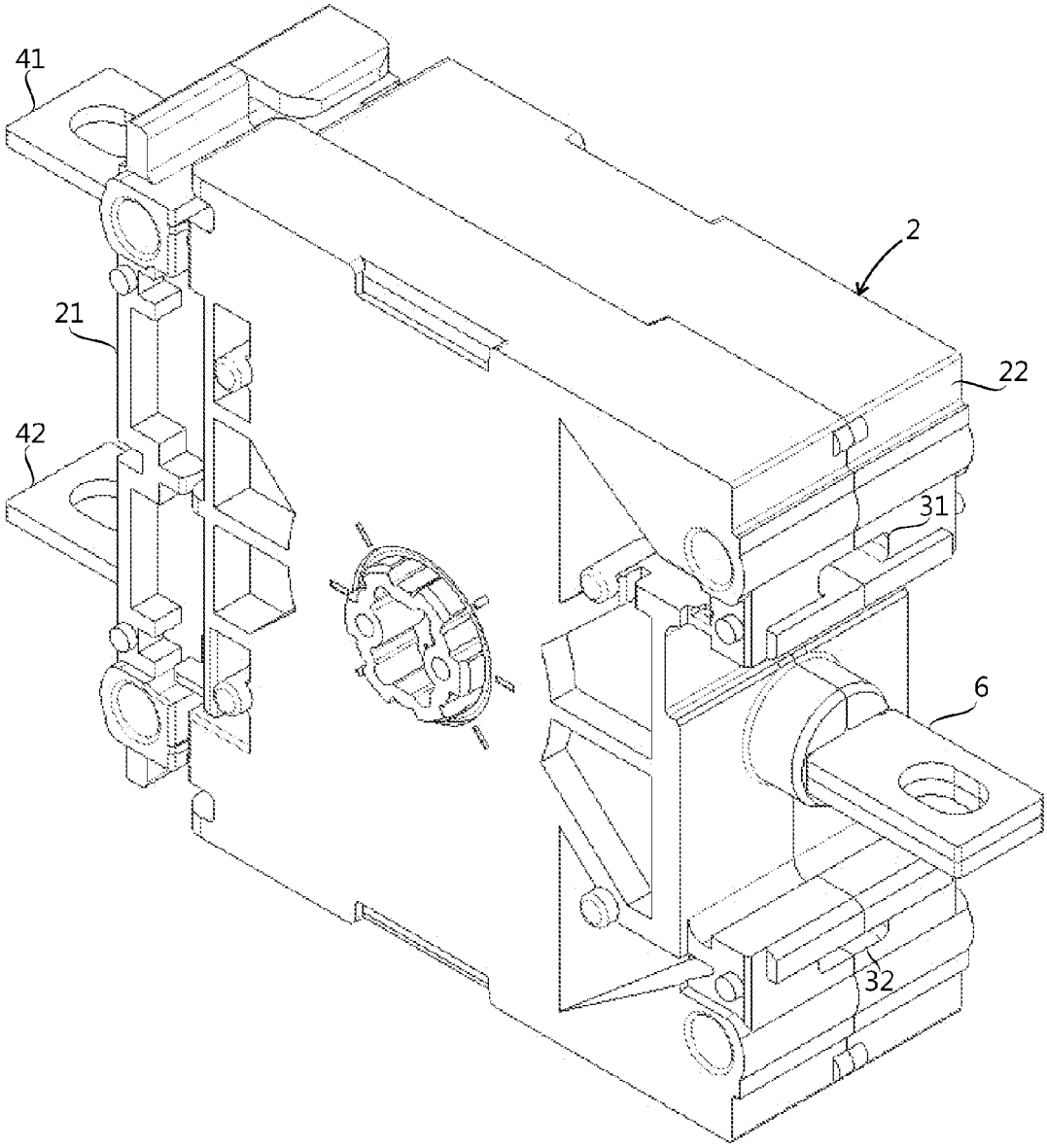
FIG. 1 shows a change-over switch according to an embodiment of the invention.

FIG. 1 shows a change-over switch comprising a frame 2, a first supply terminal 41 adapted to be connected to a first power supply, a second supply terminal 42 adapted to be connected to a second power supply, and a load terminal 6 adapted to be connected to a load. The first supply terminal 41 and the second supply terminal 42 project from a first side wall 21, and the load terminal 6 projects from a second side wall 22. The second side wall 22 faces substantially opposite direction relative to the first side wall 21. The first side wall 21 and the second side wall 22 are spaced apart in a longitudinal direction. The change-over switch of FIG. 1 is a single-phase module adapted to be coupled to other modules in order to provide a multiphase change-over switch.

Figure 2:
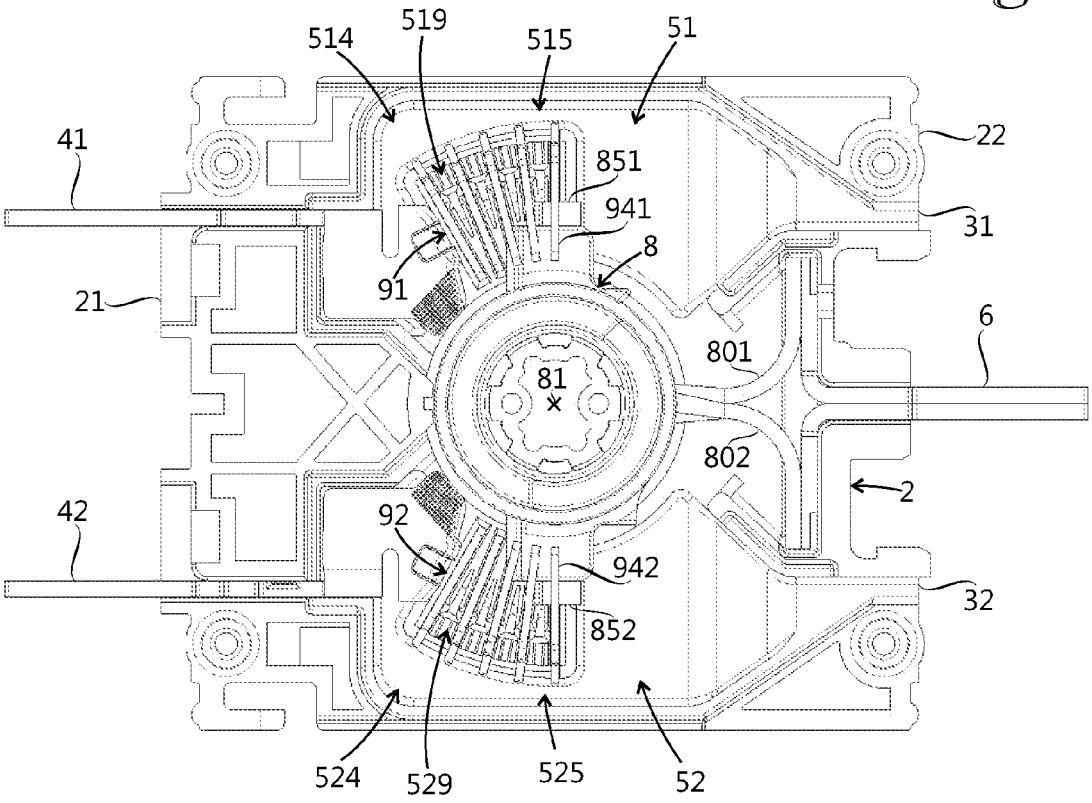
FIG. 2 is a side view of the change-over switch of FIG. 1 with half of a frame of the switch removed so as to show an internal structure of the switch.
Figure 3:
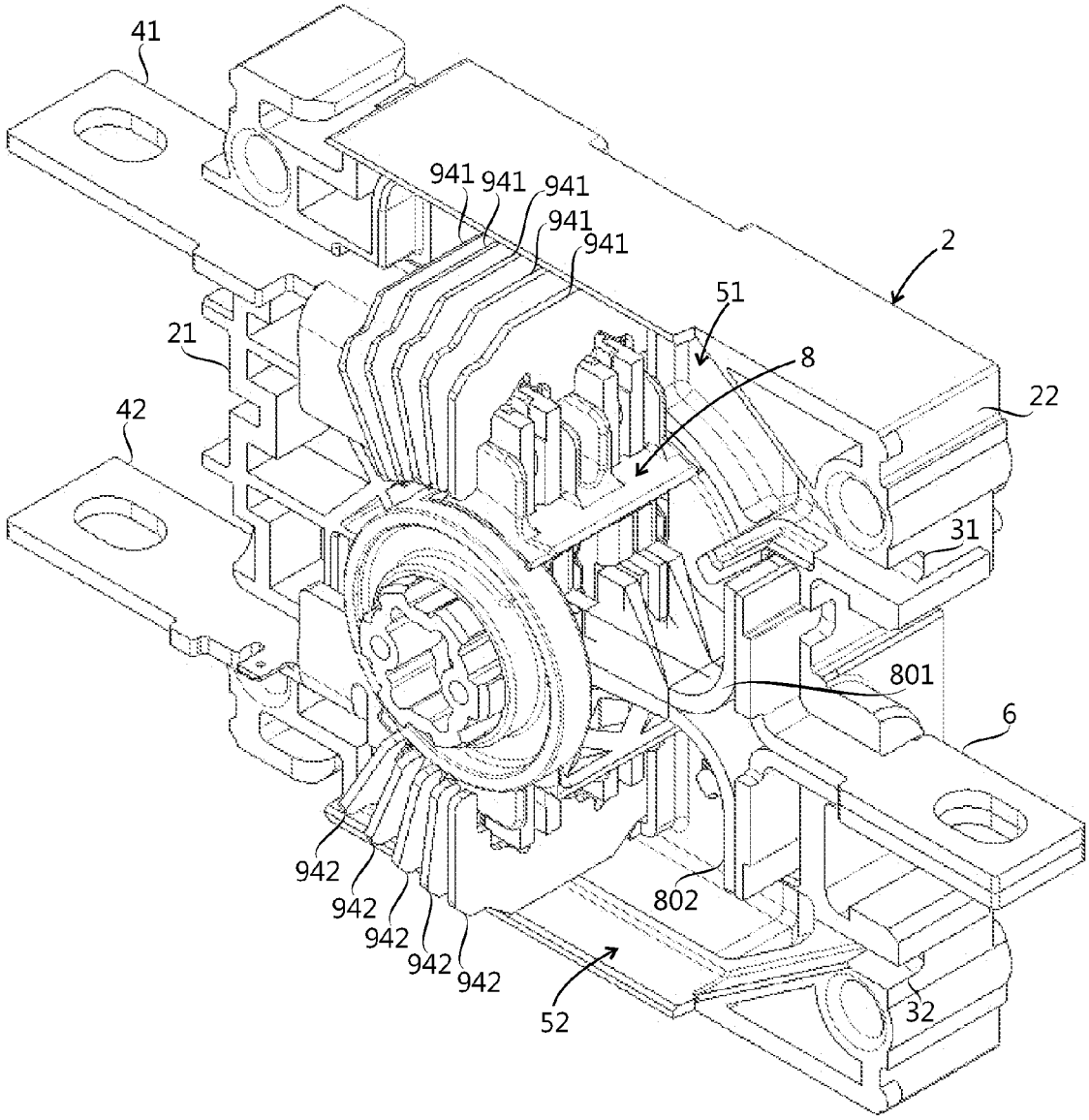
FIG. 3 shows the change-over switch of FIG. 1 with half of the frame removed.

FIG. 2 is a side view of the change-over switch of FIG. 1. In FIG. 2 a half of the frame 2 has been removed so as to show an internal structure of the change-over switch. FIG. 3 shows the change-over switch of FIG. 1 with half of the frame 2 removed. FIGS. 2 and 3 show that the change-over switch comprises a selector contact 8, a gas discharge arrangement, a plurality of first arc extinguisher plates 941 and a plurality of second arc extinguisher plates 942.

The gas discharge arrangement comprises a first gas discharge passage 51, a second gas discharge passage 52, a first gas flow opening 31 and a second gas flow opening 32. The first gas discharge passage 51 comprises a remote portion 514, an outer portion 515 and a plate portion 519. The second gas discharge passage 52 comprises a remote portion 524, an outer portion 525 and a plate portion 529.

The selector contact 8 is adapted to rotate relative to the frame 2 around a rotation axis 81 between a first position and a second position. The rotation axis 81 is perpendicular to the longitudinal direction. In the first position the selector contact 8 electrically conductively connects the first supply terminal 41 to the load terminal 6, and electrically isolates the second supply terminal 42 from the load terminal 6. In the second position the selector contact 8 electrically conductively connects the second supply terminal 42 to the load terminal 6, and electrically isolates the first supply terminal 41 from the load terminal 6. The frame 2 is made from material whose electrical conductivity is low.

The selector contact 8 comprises a first blade contact 851 for establishing electrically conductive connection with the first supply terminal 41, and a second blade contact 852 for establishing electrically conductive connection with the second supply terminal 42. Electrically conductive connection between the selector contact 8 and the first supply terminal 41 is adapted to be closed and opened in a first contact zone 91. Electrically conductive connection between the selector contact 8 and the second supply terminal 42 is adapted to be closed and opened in a second contact zone 92. The contact zones 91 and 92, and the plurality of first arc extinguisher plates 941 and the plurality of second arc extinguisher plates 942 are located inside the frame 2.

The selector contact 8 is in a fixed electrically conductive connection with the load terminal 6. The fixed electrically conductive connection between the selector contact 8 and the load terminal 6 comprises two braided conductors 801 and 802, which are adapted to allow rotation between the selector contact 8 and the load terminal 6 due to flexibility thereof. The braided conductors 801 and 802 are made from copper wire.

The gas discharge arrangement is adapted for discharging gasses produced by switching events from the frame 2. The switching events comprise a first type switching event occurring between the selector contact 8 and the first supply terminal 41, and a second type switching event occurring between the selector contact 8 and the second supply terminal 42. The first type switching event takes place in the first contact zone 91, and the second type switching event takes place in the second contact zone 92.

The first gas flow opening 31 and the second gas flow opening 32 are formed in the second side wall 22, and adapted to provide a flow path for the gasses from inside the frame 2 to outside the frame 2. The first gas flow opening 31 is adapted for gasses produced in the first type switching event. The second gas flow opening 32 is adapted for gasses produced in the second type switching event. The first gas flow opening 31 and the second gas flow opening 32 are located on opposite sides of the load terminal 6 in a height direction. The height direction is perpendicular to the longitudinal direction and a width direction, the width direction being parallel to the rotation axis 81.

The first gas discharge passage 51 originates from the first contact zone 91 and ends to the first gas flow opening 31. The second gas discharge passage 52 originates from the second contact zone 92 and ends to the second gas flow opening 32. In an alternative embodiment both the first gas discharge passage and the second gas discharge passage end to the same gas flow opening. In a further alternative embodiment both the first gas flow opening and the second gas flow opening comprise a plurality of sub-openings.

Figure 4:
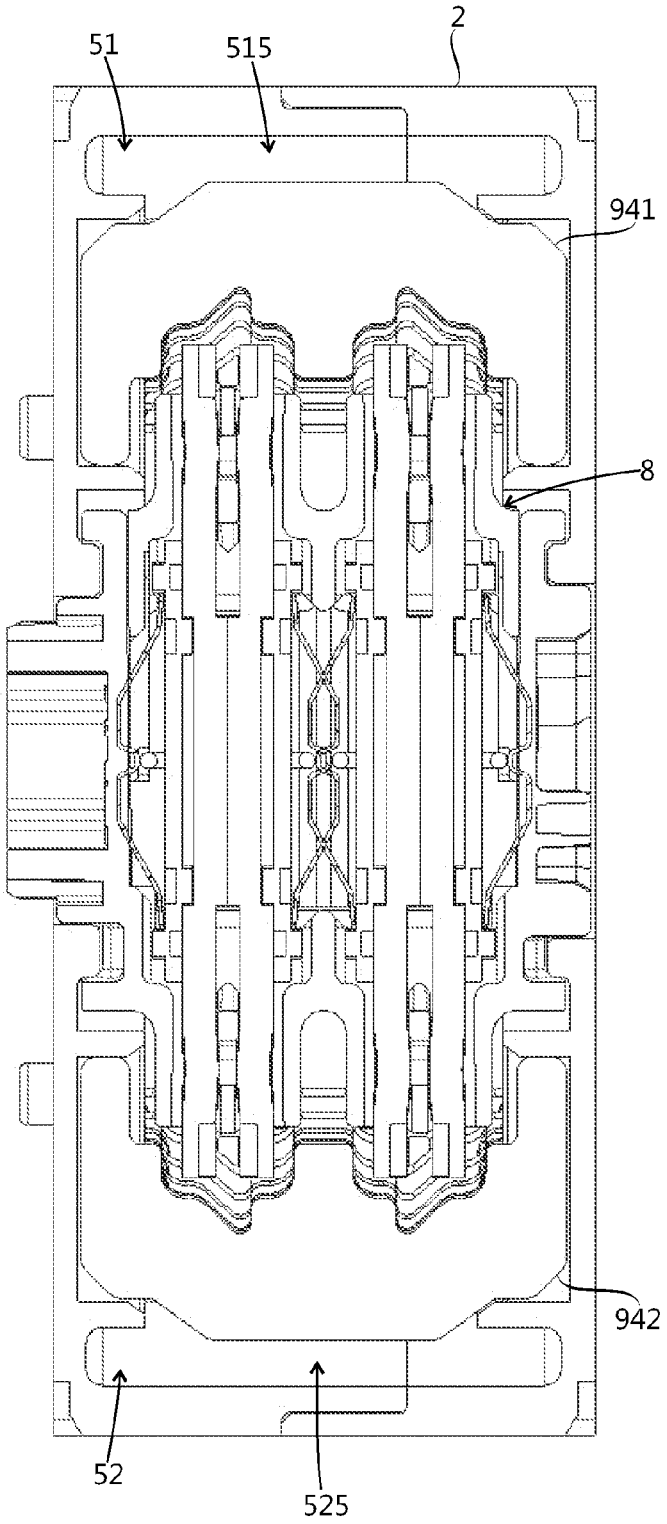
FIG. 4 shows a cross section of the change-over switch of FIG. 1 taken along a plane parallel to a first side wall of the switch, through which supply terminals of the switch extend.

FIG. 4 shows a cross section of the change-over switch of FIG. 1 taken along a plane parallel to the first side wall 21 of the switch, and passing through the selector contact 8. FIG. 4 shows that a width of each of the outer portions 515 and 525 is substantially equal to inner width of the frame 2. Further, a cross-sectional area of each of the outer portions 515 and 525 is sufficient to provide a low resistance path for the gasses. Together FIGS. 2, 3 and 4 show that the first gas discharge passage 51 provides a path of least resistance for a gas flow from the first contact zone 91 to the first gas flow opening 31, and the second gas discharge passage 52 provides a path of least resistance for a gas flow from the second contact zone 92 to the second gas flow opening 32.

The first contact zone 91 and the second side wall 22 are located on opposite sides of the rotation axis 81 in the longitudinal direction. The second contact zone 92 and the second side wall 22 are located on opposite sides of the rotation axis 81 in the longitudinal direction. Therefore both the first gas discharge passage 51 and the second gas discharge passage 52 are long passages allowing gasses produced by switching events to cool properly before discharging the gasses from the frame 2.

The plurality of first arc extinguisher plates 941 is located adjacent the first contact zone 91 and adapted to extinguish electric arcs produced in the first type switching event. The plurality of first arc extinguisher plates 941 is located between the rotation axis 81 and the outer portion 515 of the first gas discharge passage 51 in a radial direction perpendicular to the rotation axis 81. The plurality of second arc extinguisher plates 942 is located adjacent the second contact zone 92 and adapted to extinguish electric arcs produced in the second type switching event. The plurality of second arc extinguisher plates 942 is located between the rotation axis 81 and the outer portion 525 of the second gas discharge passage 52 in a radial direction perpendicular to the rotation axis 81. Majority of both the first arc extinguisher plates 941 and the second arc extinguisher plates 942 are located on opposite side of the rotation axis 81 than the second side wall 22 in the longitudinal direction.

The remote portion 514 of the first gas discharge passage 51 is located further from the second side wall 22 in the longitudinal direction than the plurality of first arc extinguisher plates 941. The remote portion 524 of the second gas discharge passage 52 is located further from the second side wall 22 in the longitudinal direction than the plurality of second arc extinguisher plates 942. Gasses passing through the remote portions 514 and 524 travel substantially longer distance than a direct distance between the corresponding contact zone and gas flow opening. Further, when flowing from a contact zone to corresponding remote portion, gasses actually recede from corresponding gas flow opening, which makes the path of the gasses longer and allows the gasses to cool more.

Each of the plurality of first arc extinguisher plates 941 and each of the plurality of second arc extinguisher plates 942 is a substantially planar element which defines a corresponding extinguisher plate plane. The extinguisher plate plane of each first arc extinguisher plate 941 and each second arc extinguisher plate 942 is positioned such that a radial direction is substantially parallel to the extinguisher plate plane, the radial direction is a direction perpendicular to the rotation axis 81. The shape of the arc extinguisher plates 941 and 942 can be best seen in FIGS. 3 and 4.

Each of the plurality of first arc extinguisher plates 941 and each of the plurality of second arc extinguisher plates 942 is made from zinc-plated steel. Each of the first arc extinguisher plates 941 and each of the plurality of second arc extinguisher plates 942 is electrically isolated from the other arc extinguisher plates 941 and 942. In an alternative embodiment each of the plurality of first arc extinguisher plates and each of the plurality of second arc extinguisher plates is made from another material with high electrical and thermal conductivity.

The plate portion 519 of the first gas discharge passage 51 extends between the plurality of first arc extinguisher plates 941. The plate portion 529 of the second gas discharge passage 52 extends between the plurality of second arc extinguisher plates 942. The plate portion 519 of the first gas discharge passage 51 is in gas connection with the outer portion 515 of the first gas discharge passage 51. The plate portion 529 of the second gas discharge passage 52 is in gas connection with the outer portion 525 of the second gas discharge passage 52.

Plate portions 519 and 529 of the gas discharge passages 51 and 52 cool gasses passing through them effectively due to high thermal conductivity of the arc extinguisher plates 941 and 942. The arc extinguisher plates 941 and 942 are adapted to absorb heat from gasses passing through the plate portions 519 and 529.

It will be obvious to a person skilled in the art that the inventive concept can be implemented in various ways. The invention and its embodiments are not limited to the examples described above but may vary within the scope of the claims.

The invention claimed is:

1. A change-over switch comprising:

a frame having a first side wall and a second side wall facing opposite direction relative to the first side wall, the first side wall and the second side wall being spaced apart in a longitudinal direction;

a first supply terminal adapted to be connected to a first power supply;

a second supply terminal adapted to be connected to a second power supply;

a load terminal adapted to be connected to a load;

a selector contact adapted to rotate relative to the frame around a rotation axis between a first position in which the selector contact electrically conductively connects the first supply terminal to the load terminal, and a second position in which the selector contact electrically conductively connects the second supply terminal to the load terminal, wherein electrically conductive connection between the selector contact and the first supply terminal is adapted to be closed and opened in a first contact zone, and electrically conductive connection between the selector contact and the second supply terminal is adapted to be closed and opened in a second contact zone; and a gas discharge arrangement for discharging gasses produced by switching events from the frame, the switching events comprising a first type switching event occurring between the selector contact and the first supply terminal, and a second type switching event occurring between the selector contact and the second supply terminal, the gas discharge arrangement comprising a first gas discharge passage, a second gas discharge passage and at least one gas flow opening, wherein the at least one gas flow opening is formed in the frame, and adapted to provide a flow path for the gasses from inside the frame to outside the frame, the first gas discharge passage originating from the first contact zone and ending to the at least one gas flow opening, and the second gas discharge passage originating from the second contact zone and ending to the at least one gas flow opening, the first supply terminal and the second supply terminal project from the first side wall, and the load terminal projects from the second side wall, and the at least one gas flow opening is formed in the second side wall, wherein the first contact zone and the second side wall are located on opposite sides of the rotation axis in the longitudinal direction, and the second contact zone and the second side wall are located on opposite sides of the rotation axis in the longitudinal direction, and wherein the change-over switch comprises a plurality of first arc extinguisher plates located adjacent the first contact zone and adapted to extinguish electric arcs produced in the first type switching event, the first gas discharge passage comprising an outer portion, the plurality of first arc extinguisher plates being located between the rotation axis and the outer portion of the first gas discharge passage in a radial direction perpendicular to the rotation axis; and a plurality of second arc extinguisher plates located adjacent the second contact zone and adapted to extinguish electric arcs produced in the second type switching event, the second gas discharge passage comprising an outer portion, the plurality of second arc extinguisher plates being located between the rotation axis and the outer portion of the second gas discharge passage in a radial direction perpendicular to the rotation axis.

2. The change-over switch according to claim 1, wherein the first gas discharge passage comprises a plate portion extending between the plurality of first arc extinguisher plates, and the second gas discharge passage comprises a plate portion extending between the plurality of second arc extinguisher plates, wherein the plate portion of the first gas discharge passage is in gas connection with the outer portion of the first gas discharge passage, and the plate portion of the second gas discharge passage is in gas connection with the outer portion of the second gas discharge passage.

3. The change-over switch according to claim 2, wherein each of the plurality of first arc extinguisher plates and each of the plurality of second arc extinguisher plates is a planar element which defines a corresponding extinguisher plate plane, and is positioned such that a radial direction is parallel to the extinguisher plate plane, the radial direction is a direction perpendicular to the rotation axis.

4. The change-over switch according to claim 3, wherein each first arc extinguisher plate and each second arc extinguisher plate is made from material having high electrical and thermal conductivity, and each of the arc extinguisher plates is electrically isolated from the other arc extinguisher plates.

5. The change-over switch according to claim 3, wherein the first gas discharge passage comprises a remote portion located further from the second side wall in the longitudinal direction than the plurality of first arc extinguisher plates, and the second gas discharge passage comprises a remote portion located further from the second side wall in the longitudinal direction than the plurality of second arc extinguisher plates.

6. The change-over switch according to claim 3, wherein at least majority of both the first arc extinguisher plates and the second arc extinguisher plates are located on opposite side of the rotation axis than the second side wall in the longitudinal direction.

7. The change-over switch according to claim 2, wherein each of the plurality of first arc extinguisher plates and each of the plurality of second arc extinguisher plates is a planar element which defines a corresponding extinguisher plate plane, and is positioned such that a radial direction is parallel to the extinguisher plate plane, the radial direction is a direction perpendicular to the rotational axis.

8. The change-over switch according to claim 2, wherein each first arc extinguisher plate and each second arc extinguisher plate is made from material having high electrical and thermal conductivity, and each of the arc extinguisher plates is electrically isolated from the other arc extinguisher plates.

9. The change-over switch according to claim 2, wherein the first gas discharge passage comprises a remote portion located further from the second side wall in the longitudinal direction than the plurality of first arc extinguisher plates, and the second gas discharge passage comprises a remote portion located further from the second side wall in the longitudinal direction than the plurality of second arc extinguisher plates.

10. The change-over switch according to claim 2, wherein at least majority of both the first arc extinguisher plates and the second arc extinguisher plates are located on opposite side of the rotation axis than the second side wall in the longitudinal direction.

11. The change-over switch according to claim 1, wherein each first arc extinguisher plate and each second arc extinguisher plate is made from material having high electrical and thermal conductivity, and each of the arc extinguisher plates is electrically isolated from the other arc extinguisher plates.

12. The change-over switch according to claim 1, wherein the first gas discharge passage comprises a remote portion located further from the second side wall in the longitudinal direction than the plurality of first arc extinguisher plates, and the second gas discharge passage comprises a remote portion located further from the second side wall in the longitudinal direction than the plurality of second arc extinguisher plates.

13. The change-over switch according to claim 1, wherein at least majority of both the first arc extinguisher plates and the second arc extinguisher plates are located on opposite side of the rotation axis than the second side wall in the longitudinal direction.

14. The change-over switch according to claim 1, wherein the at least one gas flow opening comprises a first gas flow opening for gasses produced in the first type switching event, and a second gas flow opening for gasses produced in the second type switching event, the first gas glow opening and the second gas flow opening being located on opposite sides of the load terminal in a height direction which is perpendicular to the longitudinal direction and a width direction, the width direction being parallel to the rotation axis.

15. The change-over switch according to claim 1, wherein the at least one gas flow opening comprises a first gas flow opening for gasses produced in the first type switching event, and a second gas flow opening for gasses produced in the second type switching event, the first gas flow opening and the second gas flow opening being located on opposite sides of the load terminal in a height direction which is perpendicular to the longitudinal direction and a width direction, the width direction being parallel to the rotation axis.

16. The change-over switch according to claim 1, wherein the selector contact is in a fixed electrically conductive connection with the load terminal.

17. A change-over switch comprising:

a frame having a first side wall and a second side wall facing opposite direction relative to the first side wall, the first side wall and the second side wall being spaced apart in a longitudinal direction;

a first supply terminal adapted to be connected to a first power supply;

a second supply terminal adapted to be connected to a second power supply;

a load terminal adapted to be connected to a load;

a selector contact adapted to rotate relative to the frame around a rotation axis between a first position in which the selector contact electrically conductively connects the first supply terminal to the load terminal, and a second position in which the selector contact electrically conductively connects the second supply terminal to the load terminal, wherein electrically conductive connection between the selector contact and the first supply terminal is adapted to be closed and opened in a first contact zone, and electrically conductive connection between the selector contact and the second supply terminal is adapted to be closed and opened in a second contact zone; and a gas discharge arrangement for discharging gasses produced by switching events from the frame, the switching events comprising a first type switching event occurring between the selector contact and the first supply terminal, and a second type switching event occurring between the selector contact and the second supply terminal, the gas discharge arrangement comprising a first gas discharge passage, a second gas discharge passage and at least one gas flow opening, wherein the at least one gas flow opening is formed in the frame, and adapted to provide a flow path for the gasses from inside the frame to outside the frame, the first gas discharge passage originating from the first contact zone and ending to the at least one gas flow opening, and the second gas discharge passage originating from the second contact zone and ending to the at least one gas flow opening, the first supply terminal and the second supply terminal project from the first side wall, and the load terminal projects from the second side wall, and the at least one gas flow opening is formed in the second side wall, wherein the selector contact is in a fixed electrically conductive connection with the load terminal.

18. The change-over switch according to claim 17, wherein the fixed electrically conductive connection between the selector contact and the load terminal comprises at least one braided conductor.

* * * * *